US006974350B1

(12) United States Patent
Chen

(10) Patent No.: US 6,974,350 B1
(45) Date of Patent: Dec. 13, 2005

(54) CARD RECEPTION DEVICE

(75) Inventor: Yen-Hung Chen, Hsintien (TW)

(73) Assignee: Jess-Link Products Co., Ltd., Taipei (TW)

( * ) Notice: Subject to any disclaimer, the term of this patent is extended or adjusted under 35 U.S.C. 154(b) by 4 days.

(21) Appl. No.: 10/959,087

(22) Filed: Oct. 7, 2004

(51) Int. Cl.[7] ..... H01R 24/00
(52) U.S. Cl. ..... 439/630; 439/541.5
(58) Field of Search ..... 439/630, 79, 64, 439/541.1

(56) References Cited

U.S. PATENT DOCUMENTS 5,453,016 A * 9/1995 Clark et al. ..... 439/79
5,596,486 A * 1/1997 Young et al. ..... 361/737
6,361,367 B1 * 3/2002 Daikuhara et al. ..... 439/608
6,641,413 B2 * 11/2003 Kuroda ..... 439/159
6,776,631 B2 * 8/2004 Shimada et al. ..... 439/159

* cited by examiner

*Primary Examiner*—P. Austin Bradley
*Assistant Examiner*—Phuongchi Nguyen
(74) *Attorney, Agent, or Firm*—Rosenberg, Klein & Lee

(57) ABSTRACT

A card reception device includes an insulating housing, a plurality of contact sets, a connection module and a transiting mechanism. The insulating housing includes a printed circuit board disposed in a bottom thereof and a soldering portion arranged on the printed circuit board. The contact sets electronically connect to the printed circuit board. The connection module includes a base orientated to the insulating housing and a plurality of touching contacts and leading contacts arranged to opposite sides of the base. The transiting mechanism used to electrically connect the soldering portion of the printed circuit board includes a transiting contact set, a compression member orientated to the insulating housing in order to suppress against the transiting contact set, and a transiting member orientated to the insulating housing and electrically connecting the connection module and a plurality of first approaching contacts that are arranged on the transiting contact set.

10 Claims, 5 Drawing Sheets

CARD RECEPTION DEVICE

BACKGROUND OF THE INVENTION

1. Field of the Invention

The present invention relates to a card reception device, and particularly relates to a card reception device for communication between an electronic card and an electronic product, which includes soldering contacts arranged in a single-edge single-row manner.

2. Background of the Invention

A card reception device is used for receiving an electronic card for information communication. To accommodate various types and sizes of the electronic cards, an all-in-one card reception device is provided.

The all-in-one card reception device should include a plurality of sets of contacts relative to various-types of electronic cards, so that a first set of contacts corresponds to a first-type electronic card, a second set of contacts corresponds to a second-type electronic card, and so on. Each set of contacts should be mounted to a predetermined circuit of a board, the signal joints of the set of the contacts are arranged on each lateral side of the board in order to connect to, for example, a single row projecting soldering contacts on each side. The board mounts to an electronic device with projecting soldering contacts by a SMT process, a first type, a multi-side, the card reception device is thereby made. A second type card reception device is a single side card reception device on which are arranged lots rows of projecting soldering contacts, for example, two rows of a single side.

However, the first type card reception device should conquer the problems of evenness of each contact and the co-planarity of each side, which results in poor or open contacts. Sometimes this card reception device will enlarge the board to increase the area for the components or more circuits due to too many solders of the contacts. The first-type card reception device fails to achieve the qualities of being lightweight, thin and small.

With regard to the second-type card reception device, not many problems occur to the projecting soldering contacts of an exterior row, on the contrary, solder skips occur easily to the projecting soldering contacts of an interior row. Furthermore, the solder skips are difficult to touch upwhich has long been criticized.

The all-in-one card reception device is usually made fixedly. If a new card is designed, or an old-fashioned card becomes extinct, or types of the all-in-one card reception device need to be exchanged for other types, for example, an all-in-one device with XD, SD and SM types is changed to that with XD, SD and CF types the card reception device must be replaced. Therefore, a new, additional mold should be provided, and the manufacturing costs can't decrease. As per the descriptions mentioned above, the all-in-one device with XD, SD and SM types cannot use XD, SD and CF types. The all-in-one card reception device, in fact, is not really a universal card reception device.

Hence, an improvement over the prior art is required to overcome these disadvantages.

SUMMARY OF INVENTION

The primary object of the invention is therefore to specify a card reception device that can provide projecting soldering contacts in a single-side, single-row manner. The card reception device has perfect evenness with each contact and excellent co-planarity with each side, thus allowing easy soldering, touching up and processing, while also avoiding solder skips, poor or open contacts. Furthermore, a set of contacts can be modulized as a connection module, thus allowing parts to be exchanged in a manufacturing process in order to apply for various electronic cards without the need for a new, additional mold.

According to the invention, the object is achieved by a card reception device that includes:

an insulating housing including a printed circuit board disposed in a bottom thereof and a soldering portion arranged on the printed circuit board;

a plurality of contact sets electronically connecting to the printed circuit board;

a connection module having a base orientated to the insulating housing, and a plurality of touching contacts and leading contacts arranged to opposite sides of the base; and a transiting mechanism including a transiting contact set, a compression member orientated to the insulating housing in order to suppress against the transiting contact set, and a transiting member orientated to the insulating housing and electrically connecting the connection module and a plurality of first approaching contacts that are arranged on the transiting contact set, wherein the transiting member is used to electrically connect the soldering portion of the printed circuit board and a plurality of second approaching contacts.

To provide a further understanding of the invention, the following detailed description illustrates embodiments of the invention. Examples of the more important features of the invention have thus been summarized rather broadly so that the detailed description that follows may be better understood, and in order that the contributions to the art may be appreciated. There are, of course, additional features of the invention that will be described hereinafter and which will form the subject of the claims.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
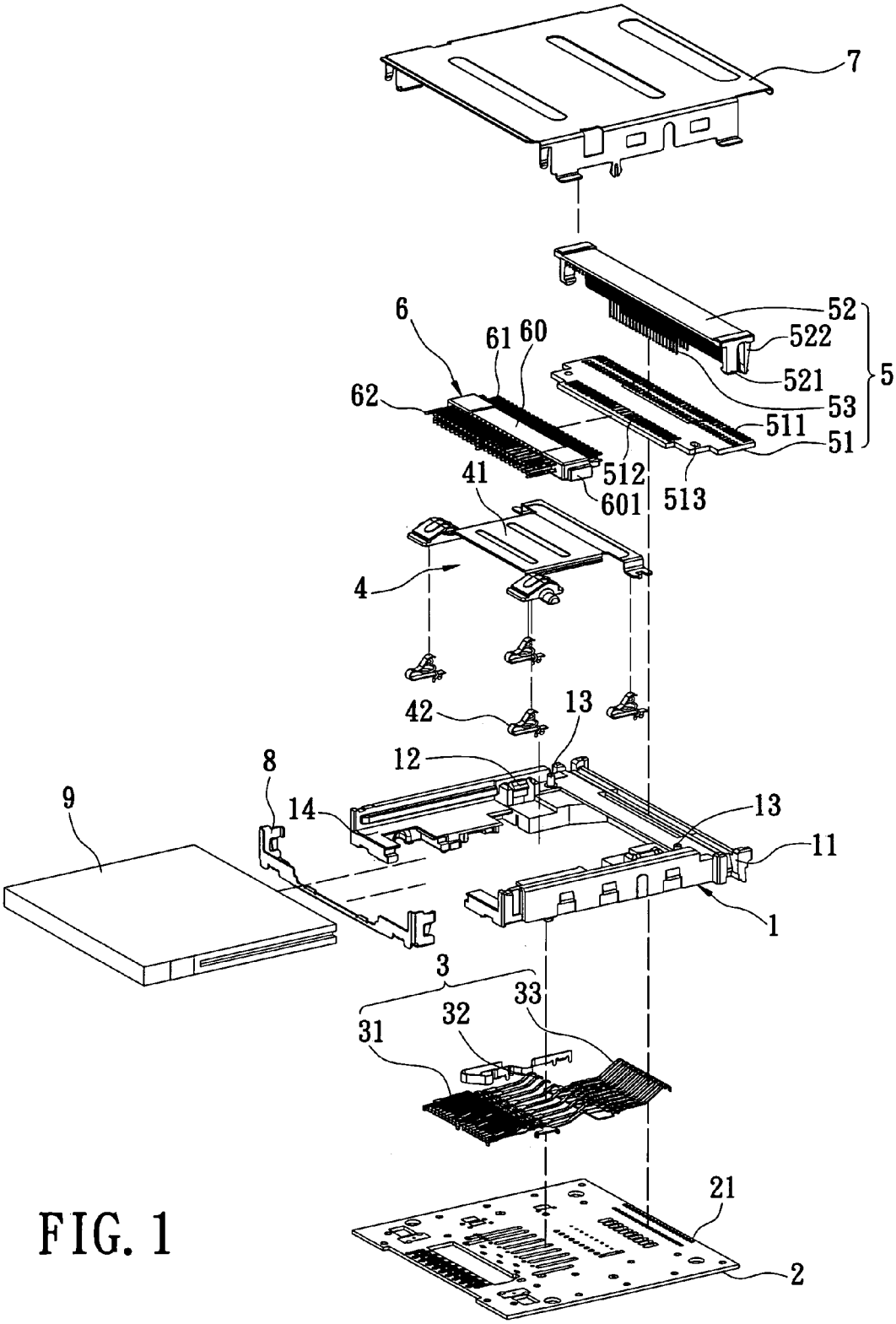
FIG. 1 is a decomposition view according to a card reception device.
Figure 2:
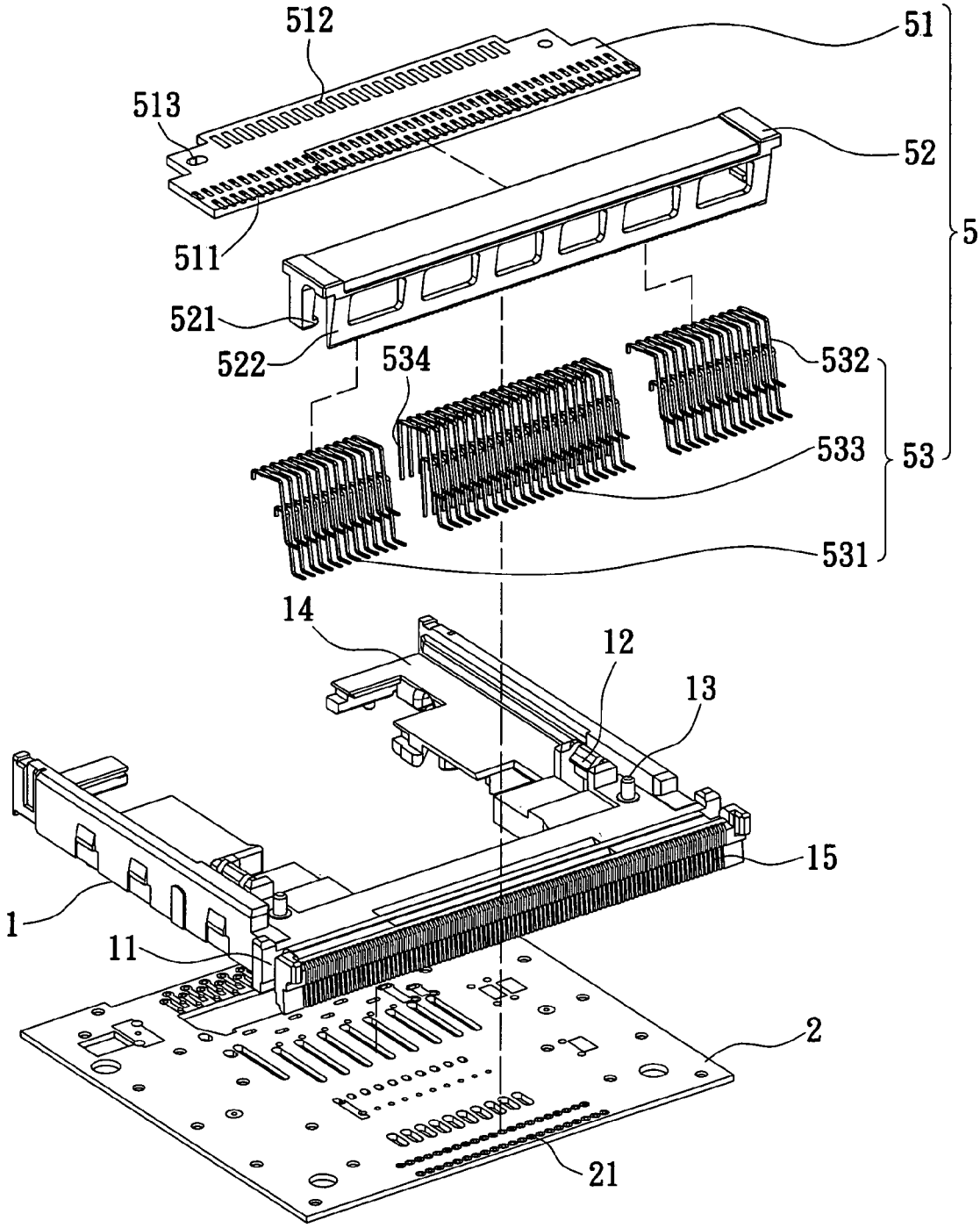
FIG. 2 is an enlarged, rear and decomposition view according to the card reception device.
Figure 3:
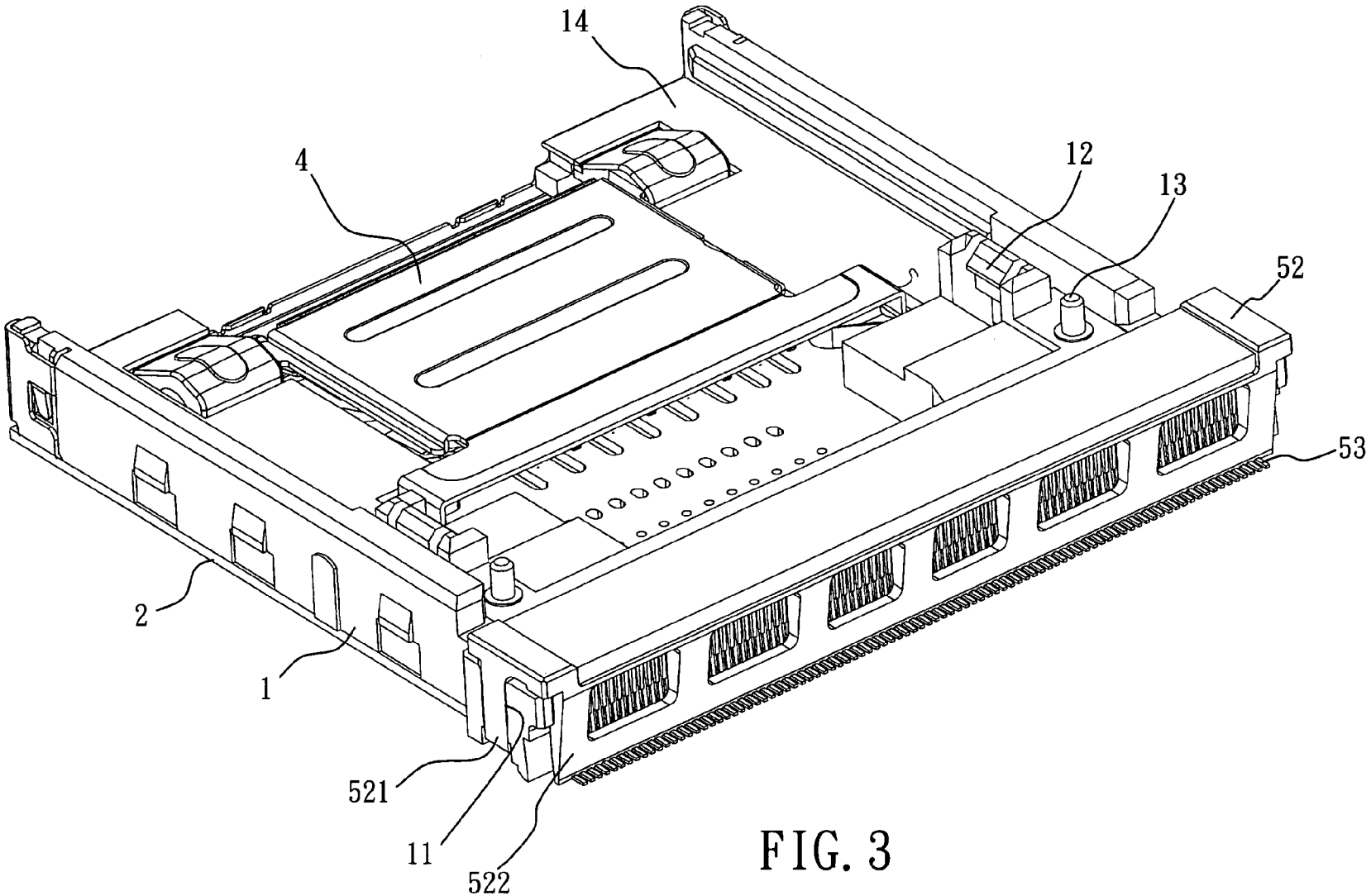
FIG. 3 is an enlarged, rear and perspective view according to the card reception device.
Figure 4:
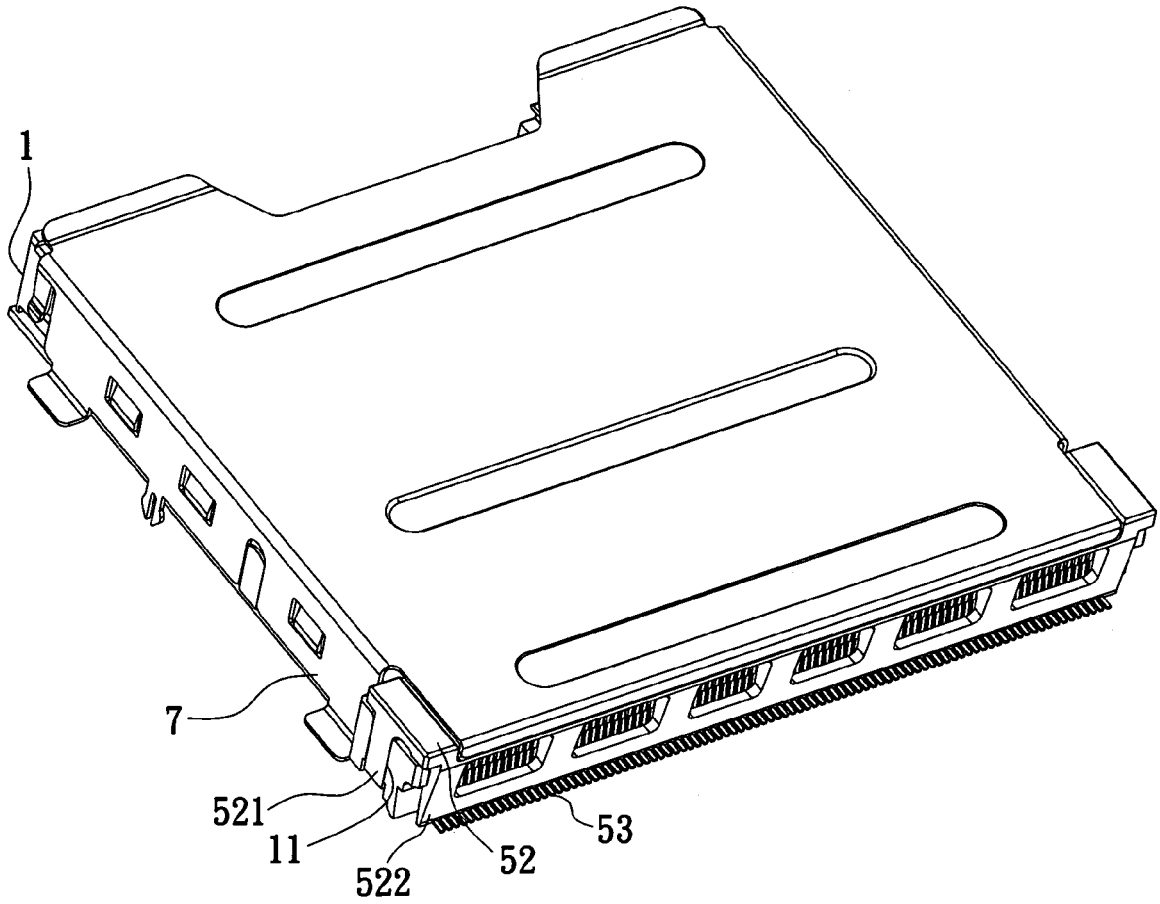
FIG. 4 is a rear, perspective view according to the card reception device.
Figure 5:
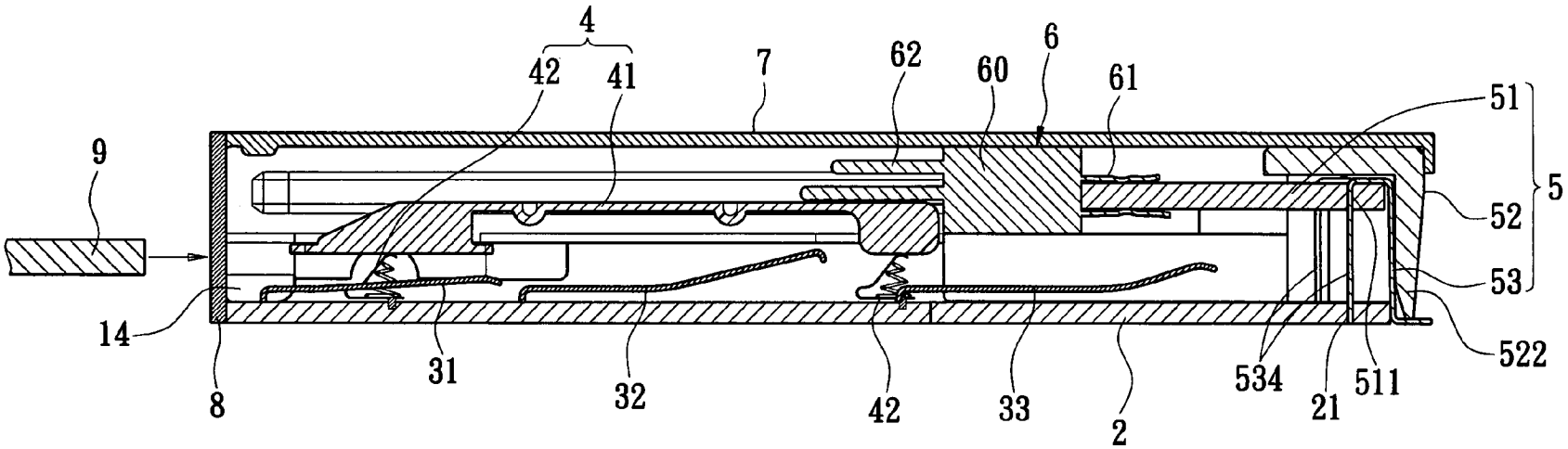
FIG. 5 is a first cross-sectional profile according to the card reception device.
Figure 6:
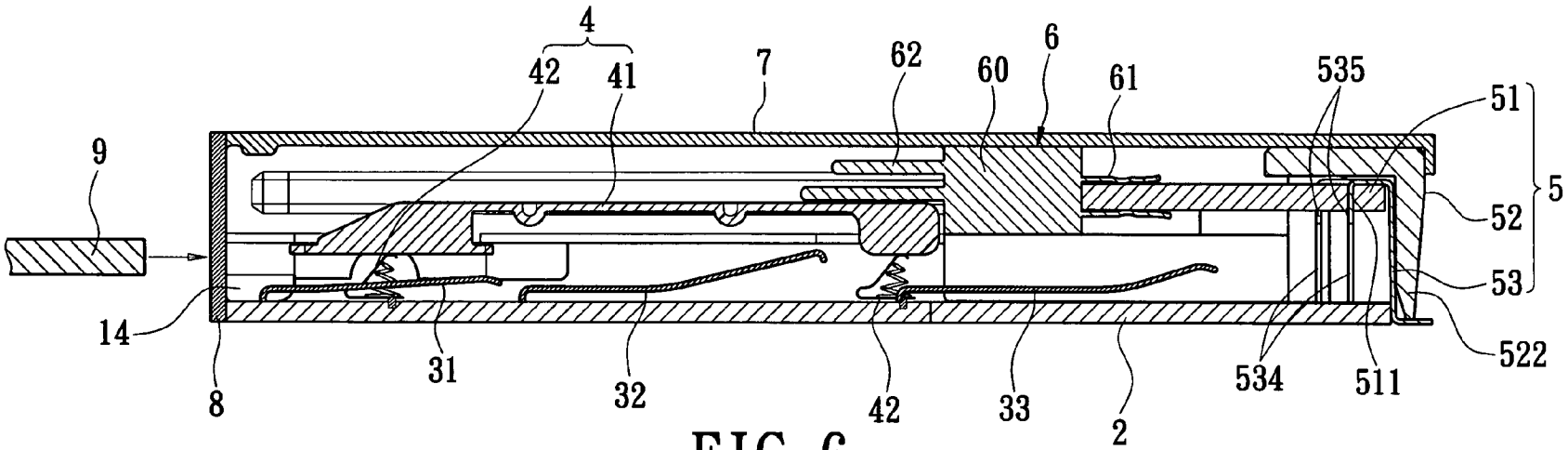
FIG. 6 is a second cross-sectional profile according to the card reception device.

With respect to FIGS. 1 to 6, the present invention provides a card reception device for receiving an electronic card 9 and communicating with the electronic card 9 and an electronic device. The card reception device includes an insulating housing 1 including a printed circuit board 2 disposed in a bottom thereof, a plurality of contact sets 3, an idiot-proofing mechanism 4, a connection module 6, a transiting mechanism 5, a metallic casing 7 and a front plate 8.

The insulating housing 1 is U shaped and has an opening 14, the insulating housing 1 includes a fastener 11 disposed on a rear portion of each lateral side thereof, a plurality of passageways 15 formed on the rear portion thereof (see FIG. 2), and a pair of buckling members 12 and a pair of orientation posts 13 disposed on a top thereof. The buckling members 12 are shaped like arms. The printed circuit board 2 includes a soldering portion 21 arranged on a rear portion thereof, the soldering portion 21 corresponds to the passageways 15, and the soldering portion 21 has two rows in an alternate manner.

The contact sets 3 include first, second and third contact sets 31, 32 and 33, which are electrically connect the printed circuit board 2.

The idiot-proofing mechanism 4 includes a plurality of resilient members 42 disposed on the printed circuit board and a lifted plate 41 restricted to the insulating housing 1. The lifted plate 41 cannot escape upwardly and has four corners supported by the resilient members 42, respectively. If the electronic card 9 is inserted into a first position of the card reception device and to suppress the lifted plate 41 (or to support the lifted plate 41), another electronic card cannot be inserted into a second position thereby, thus an idiot-proofing function is provided. The idiot-proofing mechanism 4 is arranged on the printed circuit board 2 and between touching pluralities of contacts 62 of the connection module 6 and the plurality of contact sets 3.

The connection module 6 includes a base 60 orientated to the insulating housing 1 and a plurality of touching contacts 62 and leading contacts 61 arranged to opposite sides of the base 60. The base 60 includes two fastening portions 601 shaped like slots and arranged on opposite ends respectively in order, in order to correspond to the buckling members 12 of the insulating housing 1, respectively.

The transiting mechanism 5 includes a transiting contact set 53, a compression member 52 orientated to the insulating housing 1 in order to suppress against the transiting contact set 53, and a transiting member 51 orientated to the insulating housing 1 and electrically connecting the connection module 6 and a plurality of first approaching contacts 535 that are arranged on the transiting contact set 53. The transiting member 51 is also used to electrically connect the soldering portion 21 of the printed circuit board 2 and a plurality of second approaching contacts 534.

The compression member 52 includes a latch 521 on each end thereof corresponding to the fastener 11 of the insulating housing 1 so as to connect the insulating housing 1. The transiting member 51 has a plurality of orientation holes 513 formed on each ends thereof and relative to the orientation posts 13 of the insulating housing 1, respectively. The transiting member 51 includes first and second conductive portions 511 and 512 opposite to each other, the leading contacts 61 of the connection module 6 electrically connects the second conductive portion 512, and the first conductive portion 511 are provided for all the approaching contacts 534 and 535. The first conductive portion 511 includes two rows of through holes in an alternate manner for reception of the transiting contact set 53, in order to shorten the distance among the transiting contact set 53. Furthermore, the compression member 52 includes a depressor 522 abutting against the contacts of the transiting contact set 53 for evenness, so as to solder well in a SMT process.

The transiting contact set 53 includes first, second and third contact sets 531, 532 and 533. The first, second contact set 531 and 532 are disposed on lateral sides of the card reception device and the first approaching contacts 535 of the first, second contact set 531 and 532 insert into the first conductive portion 511 to transmit information from the connection module 6. The second approaching contacts 534 are connected to the third contact set 533 to insert into the first conductive portion 511 and further to the soldering portion 21 of the printed circuit board 2, in order to transmit all signals of the contact sets 3. The depressor 522 abuts against the contacts of the first, second contact set 531 and 532 for evenness.

The metallic casing 7 covers the insulating housing 1, and the front plate 8 is disposed in front of the opening 14 of the insulating housing 1 for restricting the electronic card 9.

The contact sets 3 and the connection module 6 will make the card reception device in a single-side and single-row manner via the transiting mechanism 5. All free ends of the transiting contact set 53 can be suppressed evenly by the depressor 522. The connection module 6 and the transiting member 51 can be assembled and disassembled. Thus, the connection module 6 and the transiting member 51 can be modulized to change easily, so as to apply with another type of electronic card. Thus saving on manufacturing costs and rendering the additional mold unnecessary.

The advantages according to the present invention are summarized as follows: the transiting mechanism 5 and the depressor 522 can force the transiting contact set 53 projecting therefrom, so as to achieve the evenness required to avoid solder skips and to process easily. The connection module 6 can be modulized to mate with the transiting member 511 easily, so that all kinds of electronic cards can be applied with this card reception device.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A card reception device comprising:

an insulating housing including a printed circuit board disposed in a bottom thereof and a soldering portion arranged on the printed circuit board;

a plurality of contact sets electronically connecting to the printed circuit board;

a connection module having a base orientated to the insulating housing, and a plurality of touching contacts and leading contacts arranged to opposite sides of the base; and a transiting mechanism including a transiting contact set, a compression member orientated to the insulating housing in order to suppress against the transiting contact set, and a transiting member orientated to the insulating housing and electrically connecting the connection module and a plurality of first approaching contacts that are arranged on the transiting contact set, wherein the transiting member is used to electrically connect the soldering portion of the printed circuit board and a plurality of second approaching contacts.

2. The card reception device as claimed in claim 1, wherein the compression member includes a latch on each end thereof, the insulating housing includes a fastener corresponding to the latch so as to connect to the compression member.

3. The card reception device as claimed in claim 1, wherein the insulating housing has a plurality of orientation posts, the transiting member has a plurality of orientation holes relative to the orientation posts, respectively.

4. The card reception device as claimed in claim 1, wherein the insulating housing includes a plurality of buckling members, the connection module has a plurality of fastening portions corresponding to the buckling members, respectively.

5. The card reception device as claimed in claim 1, wherein the compression member includes a depressor abutting against the contacts of the transiting contact set for evenness.

6. The card reception device as claimed in claim 1, wherein the transiting member includes first and second conductive portions opposite to each other, the leading contacts of the connection module electrically connects the second conductive portion and the transiting contact set penetrates the first conductive portion.

7. The card reception device as claimed in claim 1, wherein the transiting member includes first and second conductive portions opposite to each other, the first conductive portion has two rows of through holes in an alternate manner.

8. The card reception device as claimed in claim 1, further comprising idiot-proofing mechanism arranged on the printed circuit board and between the touching contacts of the connection module and the plurality of contact sets.

9. The card reception device as claimed in claim 8, wherein the idiot-proofing mechanism includes a plurality of resilient members disposed on the printed circuit board and a lifted plate restricted to the insulating housing, the lifted plate has four corners supporting by the resilient members, respectively.

10. The card reception device as claimed in claim 1, further comprising a metallic casing covering the insulating housing.

* * * * *